United States Patent [19]

Magda

[11] Patent Number: 4,609,041

[45] Date of Patent: Sep. 2, 1986

[54] WELL HOT OIL SYSTEM

[76] Inventor: Richard M. Magda, 194 E. Sterling Rd., Jonesville, Mich. 49250

[21] Appl. No.: 465,667

[22] Filed: Feb. 10, 1983

[51] Int. Cl.[4] ..... E21B 37/00

[52] U.S. Cl. ..... 166/62; 166/302; 166/312

[58] Field of Search ..... 166/57, 61, 62, 75 A, 166/302, 311, 312, 325, 374, 375

[56] References Cited

U.S. PATENT DOCUMENTS

| | | | |
|---|---|---|---|
| 1,484,601 | 2/1924 | Carmichael | 166/312 |
| 2,293,442 | 8/1942 | Montgomery | 166/16 |
| 2,300,348 | 10/1942 | Dana | 166/23 |
| 2,411,044 | 11/1946 | Landrum et al. | 166/312 |
| 2,704,979 | 3/1955 | Van Willigen | 103/1 |
| 3,014,531 | 12/1961 | Weaver | 166/41 |
| 3,378,078 | 4/1968 | Current | 166/325 |
| 3,542,130 | 11/1970 | Stout | 166/224 |
| 3,822,750 | 7/1974 | Ping | 166/312 |
| 4,011,906 | 3/1977 | Alexander et al. | 166/105 |
| 4,049,057 | 9/1977 | Hewes | 166/304 |

*Primary Examiner*—Stephen J. Novosad
*Assistant Examiner*—William P. Neuder
*Attorney, Agent, or Firm*—Beaman & Beaman

[57] ABSTRACT

The invention pertains to the removal of paraffin deposits from oil producing wells wherein hot fluids are used to melt the deposits. A conduit system consisting of tubing concentric to the well tube carries hot oil to the well tube at a location below the paraffin forming depth. Ports within the well tube permit the hot oil to enter the well tube during pumping, and the heated oil and melted paraffin is removed at the well head without interrupting pumping. A check valve within the hot oil conduit prevents pumped oil from entering the conduit and the apparatus permits paraffin to be removed from an oil well in less time and with less cost than previous paraffin removal systems, without interrupting pumping, and without contamination of the oil bearing formation.

3 Claims, 7 Drawing Figures

WELL HOT OIL SYSTEM

BACKGROUND OF THE INVENTION

Crude oil containing paraffin creates pumping and flow problems in that paraffin deposits build up within the well tube and upon the pumping apparatus, such as the sucker rod, at the upper regions of the well tube and rod as the majority of paraffin deposits occur within one thousand feet of the well head.

The paraffin build up problem is severe enough to interfere with the flow of oil from the well tube and in extreme cases, to prevent oil flow all together. Further, as the paraffin deposits increase, the frictional forces upon the sucker rod become greater and higher energy requirements for pumping occur. In the past, paraffin deposits have been controlled by the use of scrapers mounted upon the sucker rod, and by otherwise physically removing the paraffin from the well tube. Also, it is common to flush the well tube with a hot fluid, such as heated oil or water, and the injection of such heated fluid into the well tube at the well head will melt the paraffin and force it into the oil bearing formation. While such oil treatments temporarily clear the well tube and the associated well components of paraffin, eventually, the paraffin again enters the well tube, the deposits reoccur, and also, the oil flow characteristics of the oil bearing formation can be adversely affected by forcing the melted paraffin into the formation.

A variety of methods and apparatus have been proposed for controlling paraffin deposits within oil wells, and such proposals are typified in the disclosure of U.S. Pat. Nos. 2,293,442; 2,300,348; 2,704,979; 3,014,531; 3,542,130; 4,011,906 and 4,049,057. However, methods and apparatus such as shown in the aforementioned patents each have shortcomings which prevent such disclosures to be considered the solution to the paraffin problem, and it is still common practice to periodically deparaffin oil wells by unseating the bottom hole pump, introducing heated oil into the well tube to melt the paraffin deposits and forcing the oil containing the melted paraffin into the oil bearing field, resulting in high cost, extensive pumping down time, and contamination of the oil bearing formation.

It is an object of the invention to provide a method of removing paraffin from an oil well wherein well pumping is not interrupted, and the oil bearing formation is not contaminated.

Another object of the invention is to provide a method for removing paraffin from an oil well utilizing hot fluids wherein heating of the paraffin deposits occurs both from indirect and direct contact with the heated fluid.

An additional object of the invention is to provide a hot oil system for paraffin control in oil wells wherein heated fluid is conveyed to the well tubing at a location below the paraffin forming depth and the fluid containing the melted paraffin is removed from the well at the well head.

Yet another object of the invention is to provide apparatus for removing paraffin from oil wells wherein the apparatus includes a hot oil conduit concentrically related to the well tubing and the conduit communicates with the well tubing below the paraffin forming depth.

A further object of the invention is to provide a hot oil paraffin removing system for oil wells utilizing a hot oil conduit concentrically related to the well tubing, and wherein a check valve is located within the hot oil conduit preventing pumped oil from entering the conduit.

In the practice of the invention a hot oil conduit is located within the well substantially concentric to the well tubing through which oil is removed. The conduit extends to a depth usually slightly below the paraffin forming well depth, and the conduit lower end is sealed with respect to the well inner tube. The concentric conduit has an inlet at the well head and ports defined in the well tube establish communication between the well tube and hot fluid conduit adjacent the conduit lower end. A check valve located within the conduit prevents pumped oil from entering the conduit to a significant extent, and during normal well pumping operations, the flow of oil is through the well tubing and well head, in the usual manner.

When it is desired to remove paraffin deposits, a hot fluid, usually hot oil, is heated and introduced into the conduit at the well head. As the heated oil moves downwardly through the conduit, it will heat the walls of the well tube melting paraffin deposits within the tube, and as the hot oil flows through the check valve and into the inner tube and through the ports due to the fact that the pressure within the conduit is greater than that within the tube, the hot oil will rise within the well tube heating the oil therein, and have direct contact with paraffin deposits within the well tube, and the hot oil and melted paraffin is removed from the well head. Depressurizing the hot oil conduit permits the check valve to seat whenever the pressure within the well tube exceeds a predetermined limit as when pumping.

The check valve is of an annular form inexpensive to manufacture, and the apparatus associated therewith permits trouble free service over long periods of time.

The practice of the invention saves approximately two thirds of the conventional cost of deparaffining a well, saves substantial time, and results in an improved "cleaning" of the well tubing, and depositing of the paraffin within the oil bearing formation is eliminated. The ability to "hot oil" an oil well while the well is still pumping and producing is of great advantage with respect to minimizing loss of revenue, and the apparatus and concepts of the invention are of such nature as to be readily understood and implemented by relatively low skilled operators.

DESCRIPTION OF THE DRAWINGS

The aforementioned objects and advantages of the invention will be appreciated from the following description and accompanying drawings wherein.

DESCRIPTION OF THE PREFERRED EMBODIMENT

Figures 1, 2, 3, 4, 5, 6, 7:
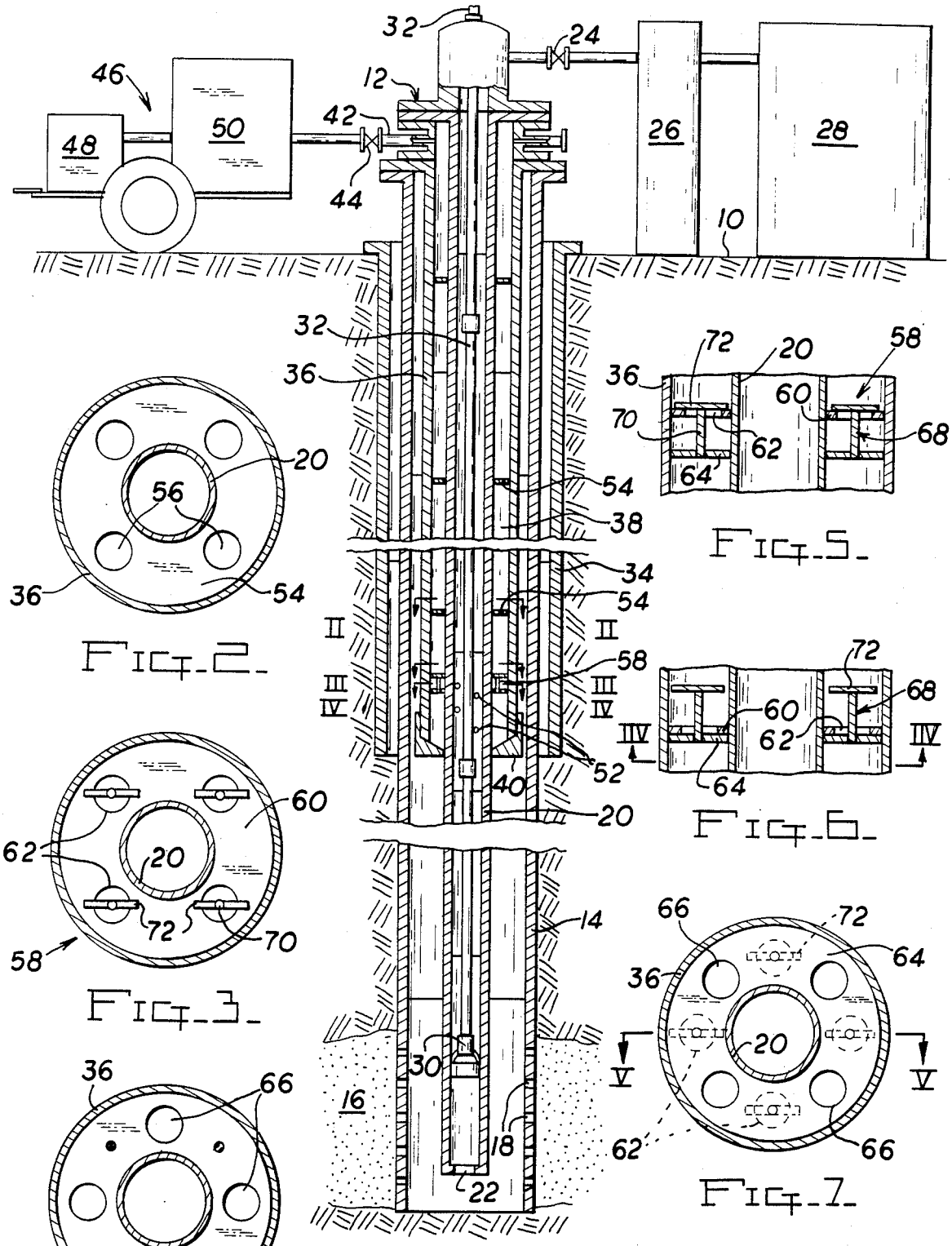
FIG. 1 is an elevational, diametrical, sectional, partially schematic view of an oil well utilizing the apparatus of the invention.
FIG. 2 is a plan sectional view of a locating ring as taken along Section II—II of FIG. 1.
FIG. 3 is a plan view of the valve as taken from the top along Section III—III of FIG. 1.
FIG. 4 is a plan sectional view as taken along Section IV—IV of FIG. 1.
FIG. 5 is an elevational, enlarged, detail, sectional view as taken along Section V—V of FIG. 7 illustrating the check valve in the open position.
FIG. 6 is a view similar to FIG. 5 illustrating the valve in the closed position.
FIG. 7 is a bottom plan view of the valve as taken along Section VII—VII of FIG. 6.

FIG. 1 illustrates a typical oil well installation utilizing the invention concepts. The surface of the ground is indicated at 10, and the well includes a plurality of sets of tubing, which, at their upper end, form a well head 12 consisting of the usual valve connections and components. The well is defined by a casing 14 having a lower end extending into the oil bearing formation 16, and openings 18 defined in the casing permit the oil to enter. The oil is removed from the casing through the inner well tube 20 whose lower end is open at 22 communicating with the oil within the casing, and the upper end of the tube 20 communicates with the well head 12, and through appropriate piping and valve 24, the oil passes through a treater 26 for storage within tank 28. The oil is pumped by a pump 30 located in the lower end of tube 20 and the pump piston is operated by the usual sucker rod system 32 extending through the well head and driven by a conventional pump drive, not shown.

A tubular surface pipe 34 usually surrounds the uppermost twelve hundred feet of the casing 14 in compliance with environmental regulations as the surface pipe prevents contamination of ground water by the well.

The apparatus for removing paraffin from the inner tube 20 in accord with the invention includes a cylindrical conduit 36 which surrounds the well tube 20 in a substantially concentric manner. The internal diameter of the conduit 36 is greater than the outer diameter of the tube 20 wherein an annular chamber 38 exists between the conduit and tube, and the lower end of the conduit is sealed with respect to the tube 20 by an annular cap 40 which is welded to both the lower end of the conduit 36 and the outer diameter of the tube 20.

The upper end of the conduit 36 communicates with the well head 12, and through piping 42 and valve 44 is in selective communication with hot oil processing apparatus generally indicated at 46, which may include pump 48 and heater 50.

Communication is established between the well tube 20 and the conduit chamber 38 by a plurality of radial ports 52 formed in the well tube, FIG. 1. Spacing between the conduit 36 and tube 20 is maintained by a plurality of axially separated spacers 54, FIG. 2, each of which include a plurality of openings 56 wherein hot fluid may flow through the spacers.

To prevent the pumped oil from entering the conduit chamber 38 during normal well operation, a check valve, generally indicated at 58, is located within the chamber adjacent the conduit lower end above the tube ports 52. In the disclosed embodiment the check valve includes an upper annular disk 60 welded at its outer diameter to the conduit 36, and welded at its inner diameter to the outer diameter of the tube 20. The upper disk includes four orifices 62, FIG. 3, through which oil may selectively flow.

The movable portion of the check valve 58 is the annular disk 64 which includes four axially extending orifices 66 located at 90° intervals, and a plurality of T-pins 68 are threaded into the disk 64 at locations intermediate the orifices 66. T-pins 68 include a shank 70 which extends through the fixed orifices 62 of disk 60, and the pins terminate in a transversely disposed head 72 of a length greater than the diameter of the orifices 62.

Thus, as apparent in FIG. 5, in the normal condition the valve disk 64 will be maintained in a parallel spaced relationship to the valve disk 60 by the pins 68 whose heads 72 rest upon the upper surface of the valve disk 60.

During pumping, the pressure within the well tube 20 will be greater than the static fluid pressure within the chamber 38, and the resulting greater pressure below the check valve 58, particularly during a lifting stroke of the pump 30, will cause the valve disk 64 to rise and engage the underside of the valve disk 60. As the T-pins 68 maintain an orientation between the disks 60 and 64 wherein the orifices 62 are misaligned by 45° with respect to the orifices 66, as apparent in FIG. 7, engagement of the disk 64 with the disk 60 seals the orifices 62 against fluid flow, and oil will not pass through the check valve. Thus, the pumped oil is prevented from entering the chamber 38.

When it is desired to remove paraffin from the well tube 20 and the paraffin deposits which have accumulated upon the sucker rod 32, the hot oil apparatus 46 is brought to the well and connected to the pipe 42. Thereupon, hot fluid, usually heated oil, but may be heated water, is heated by the heater 50, and is forced into the chamber 38 by the pump 48. As the hot fluid enters the chamber 38 it moves downwardly through the chamber and the tube 20 will be exteriorly heated and paraffin deposits upon the inner surface of the tube will melt.

The chamber 38 is pressurized by pump 48 with a pressure greater than that produced within the inner tube 20 due to the oil pumping action, and this greater pressure within chamber 38 will force hot oil through the check valve disk 60 and through disk 64 permitting fluid to enter the tube 20 through the ports 52. Due to the pumping action, and the higher temperature of the fluid entering the well tube 20, the hot fluid within the well tube rises up through the tube heating the oil and paraffin therein, causing the paraffin to melt and the paraffin, pumped oil and heated fluid, are all removed from the well tube at the well head 12 through pipe 24 into treater 26 and tank 28. The paraffin is removed from the oil at the treater or the tank by conventional techniques, and if hot water is used as the heated fluid, the water will separate from the oil within the tank, and is removed.

The hot fluid treatment of the well continues as described above, until all the paraffin has been melted and flushed from the well tube 20. After cleaning, the valve 44 is closed and the hot oil apparatus 46 is transported to the next well to be treated. The check valve 58 automatically prevents the pumped oil from entering a significant portion of the conduit 36, and well pumping continues uninterrupted.

The conduit 36 is of a length substantially equal to the surface pipe 34, such as twelve hundred feet, in that in most installations paraffin formation only occurs at the upper regions of the well. When installing the disclosed apparatus, that portion of the well tube 20 and conduit 36 required in accord with the invention are previously assembled and attached to the well tubing located therebelow in the usual manner by threaded connections, and the assembly and lowering of the assembled tubre 20 and conduit 36 occurs in accord with well known oil well rigging techniques.

As the practice of the invention does not require the unseating of the pump 30, special apparatus for this purpose is not required. Further, as the paraffin removing operation occurs while the well continues to be pumped, there is no loss of pump capacity during treatment and no revenues are lost in this regard. The heating of the paraffin due to the heating of the inner tube as the hot fluid moves downwardly through chamber 38, as well as the heating of the paraffin within the tube 20, produces a most effective dissolving of the paraffin deposits, and as the melted paraffin is permanently removed from the well through well head 12, rather than being forced into the formation 16, the amount of paraffin at the well is gradually reduced, rather than increased, as is the case with most paraffin treatment system.

It is appreciated that various modifications to the inventive concepts will be apparent to those skilled in the art without departing from the spirit and scope of the invention.

I claim:

1. Apparatus for removing paraffin from an oil well wherein the oil well includes an inner tube having a lower end receiving oil and an upper end at a well head from which oil is removed, the improvement comprising a conduit having a lower end communicating with the inner tube intermediate the lower and upper ends thereof and below the paraffin forming region thereof, said conduit having an upper end at the well head, means for selectively introducing hot fluid into said conduit upper end, check valve means adjacent said conduit lower end intermediate the tube and said conduit permitting fluid flow from said conduit into the inner tube and preventing fluid flow from the inner tube into said conduit, said conduit comprising a second tube encompassing the inner tube, said conduit lower end being substantially sealed with respect to the inner tube, a plurality of ports defined in the inner tube adjacent said conduit lower end establishing communication between the inner tube and said conduit lower end, said check valve means being located within said second tube above said ports, said check valve means comprising a first flat annular disc sealingly interposed between the inner tube and said second tube, at least one orifice defined within said first disc, and a second flat annular disc movably mounted within said second tube adjacent to and below said first disc adapted to be forced against the underside of said first disc to seal said orifice thereof by fluid pressure below said second disc, at least one orifice defined in said second disc to permit fluid flow therethrough, support means supporting said second disc adjacent to and below said first disc and orientation means defined on said second disc maintaining misalignment of said orifices of said first and second discs.

2. Apparatus for removing paraffin from an oil well as in claim 1, a plurality of orifices defined in both said first and second discs, a plurality of axially extending pins mounted upon said second disc intermediate said orifices thereof, each of said pins extending through a first disc orifice, a head defined upon each pin located above said first disc and having a diameter greater than that of the associated first disc orifice, said pins comprising said support means supporting said second disc and orienting said second disc relative to said first disc.

3. Apparatus for using hot fluids to remove paraffin from cylindrical oil well tubing having ports defined below the paraffin forming depth, comprising, in combination, a tube having an upper end, a lower end and an inner diameter concentrically disposed about the oil well tubing, an annular seal defined at said lower end adapted to seal with oil well tubing to be de-paraffined and communicate with the well tubing ports, hot fluid connection means defined at said tube upper ends, and an annular check valve mounted within said tube inner diameter in proximity to said lower end and axially spaced therefrom and located above the well tubing ports preventing pumped oil from entering said tube, said check valve including a first annular disc having an outer diameter sealed to said tube inner diameter, at least one orifice defined in said first disc, a second annular disc axially movably supported within said tube adjacent to and below said first disc movable between contiguous and spaced positions relative thereto, at least one orifice defined within said second disc and orientation means maintaining misalignment between the orifices of said disc whereby engagement of said discs closes said first disc orifice to fluid flow and separation of said discs permits fluid flow through the orifices of said discs.

* * * * *